United States Patent [19]

Jacobson

[11] 4,184,233

[45] Jan. 22, 1980

[54] FABRIC CLASP DEVICE

[76] Inventor: Samuel O. Jacobson, 11255 Gaviota Ave., Granada Hills, Calif. 91344

[21] Appl. No.: 908,949

[22] Filed: May 24, 1978

[51] Int. Cl.[2] ..... A44B 21/00

[52] U.S. Cl. ..... 24/261 R; 24/3 D; 24/81 C

[58] Field of Search ..... 24/261 R, 261 C, 3 D, 24/73 C, 84 C, 129 C, 11 C, 11 PP, 81 C, 67.9, DIG. 1 D

[56] References Cited

U.S. PATENT DOCUMENTS

| | | | |
|---|---|---|---|
| 884,637 | 4/1908 | Bythiner | 24/261 R X |
| 1,062,764 | 5/1913 | Buckley | 24/261 R |
| 1,798,651 | 3/1931 | Berry, Jr. | 24/261 R |
| 3,120,044 | 2/1964 | DiPiano | 24/261 R X |
| 3,212,303 | 10/1965 | Haffner et al. | 24/261 R X |

*Primary Examiner*—Philip C. Kannan

[57] ABSTRACT

A fabric clasp comprising a single resilient wire bent into multiple convolutions that can not only be affixed to any portion of a fabric and applied as a temporary and removable grommet, but can be applicable for other uses such as a rope cinch, pen, pencil, and paper holder, and a rope connector.

10 Claims, 20 Drawing Figures

FABRIC CLASP DEVICE

BACKGROUND OF THE INVENTION

A variety of grommets are presently marketed to enable a user to hold, stretch, hang, or otherwise control the positioning of fabric, such as a tarpaulin, by inserting rope, tent stakes, or like objects through these grommets to grasp the fabric. Available grommets and eyelets are permanently attached during the manufacturing process of most tarpaulins but these devices are also easily obtainable at stores so that anyone may affix them to fabrics. In either case, holes must be punctured through fabric or plastic tarps to enable one to attach the grommets. However, thin fabric or plastic tarps may easily tear at places where the grommets or eyelets have been installed when pressure is exerted upon the fabric while cinching the attached ropes and consequently, this has been a continuing problem in the field.

It is thus apparent that since standard grommets and eyelets have certain disadvantages, the need exists for a device that can be temporarily but securely attached to fabric for use as a grommet and then be easily removed without destroying the water resisting usefulness of the plastic or fabric tarpaulins.

My invention relates to bent wire clasps for fabrics and more particularly to a fabric clasp which is suitable for uses over and above the usual fabric clasp functions.

It is a primary object of this invention to provide an elongated wire fabric clasp comprising a plurality of resilent convolutions wherein said clasp can be manipulated to be securely attached to fabric or like material thus permitting great pressure or pull to be exerted from the clasp in opposition to the fabric without slipping loose, puncturing, or tearing the fabric and then can be easily removed so that other uses may be made of the fabric.

It is another object of this invention to provide a fabric clasp whereby a plurality of these clasps can be attached at desired locations upon a piece of fabric thus regulating the size of the stretched fabric within the perimeter of the attached clasps and further, that many fabrics may be firmly linked together by applying said clasps at the overlapped edges of the joined fabrics.

It is still another object to provide a method to relieve the tension placed upon light fabrics or plastic tarps stretched between attached and opposing clasps and to provide a clasp device with means for readily connecting rope, hooks, or other useful objects such as a nail-like tent stake to anchor said clasp to the ground.

A still further object of this invention is to provide a fabric clasp device for uses other than with fabric so that said device may function, for example, as a fulcrum for a rope cinch, be used as a clasp for paper, and serve as a pen and/or pencil holder.

Other and further objects, advantages, and features of this invention will be readily apparent from a detailed analysis of my drawings when taken in conjunction with the following specification wherein.

Figure 1:
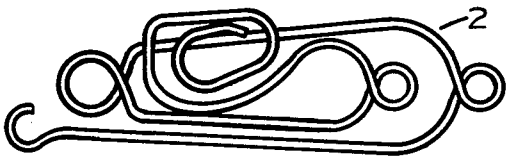
FIG. 1 is a front view in elevation of one form of fabric clasp embodying this invention.
Figure 20:
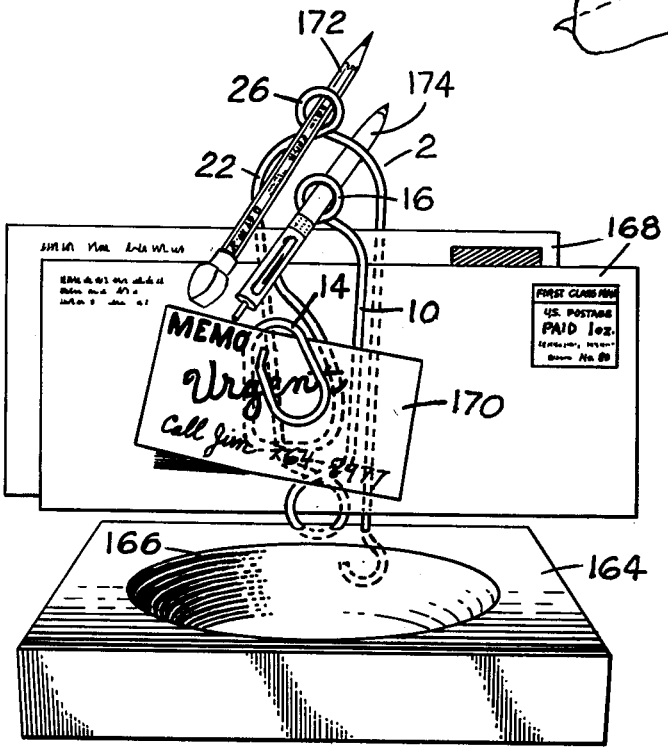

FIG. 20 is a perspective view of a fabric clasp applied as an article holder whereby its vertical positioning is stabilized by a base within which the clasp is mounted; and Referring now to my drawings, there is shown in FIG. 1 an embodiment of my fabric clasp invention which consists of a single, resilient wire 2 bent in a plurality of convolutions to form elongated component parts arranged so that they can be manipulated to contiguous positions for enclasping fabric and other useful applications.

Figure 2:
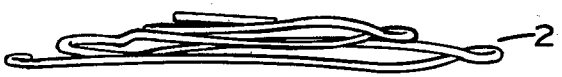
FIG. 2 is a side view in perspective of a fabric clasp.

A side view of FIG. 1, as seen in FIG. 2, shows the wire 2 with elongated components resting in spaced but connected juxtaposition and in a substantially parallel plane relationship.

FIGS. 3 through 6 illustrate four positions necessary to insert, clasp, and lock the device within the folds of fabric.

Figure 3:
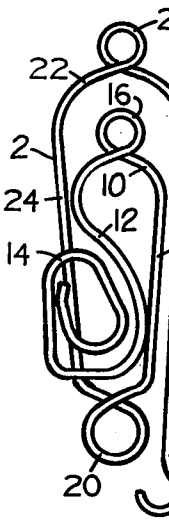
FIG. 3 is a front view in elevation of a fabric clasp resting in a first position.

The clasp 2 of FIG. 3 comprises elongated and convolved inner components 10 including a substantially S-shaped leg 12, a clip-like formation 14, an outwardly extending eyelet-like loop 16, and leg 18 connected integrally by a grommet-like loop 20 to an outer elongated and convolved component 22 comprising leg 24 located rearward of clip 14, an outwardly extending eyelet-like loop 26, and leg 28 connected to a hooked end 30.

Figure 4:
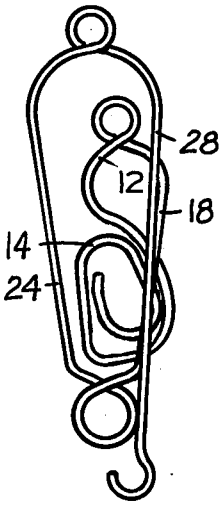
FIG. 4 is a front view in elevation of a fabric clasp sprung to a second position.

S-like convolution 12 of FIG. 4 is contracted laterally behind legs 18 and 36 to pass clip 28 rearward of leg 24.

Figure 5:
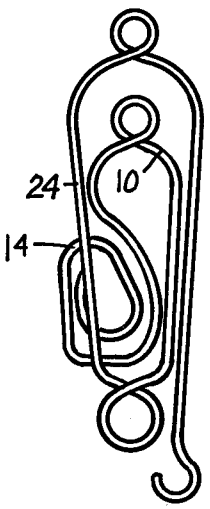
FIG. 5 is a front view in elevation of a fabric clasp unsprung to a third clasping position.

In FIG. 5, clip 14 presses forward against a rear portion of leg 24 which represents a similar but reversed position of inner components 10 and clip 14 as compared with inner components 10 and clip 14 of FIG. 3.

Figure 6:
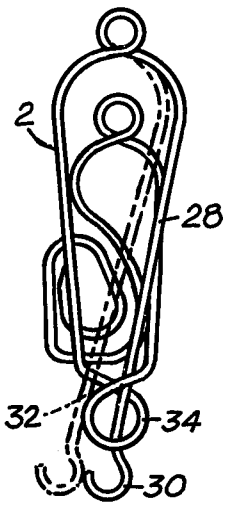
FIG. 6 is a front view in elevation of a fabric clasp in a fourth clasping and locking position.

Leg 28 of FIG. 6 is sprung laterally inward to a position indicated by phantom lines 32 whereby leg 28 can then be laterally unsprung to lock within the circumference of grommet-like component 34 which shows hook 30 adjacent to ring 34 and nearly in alignment with the longitudinal axis of the device 2.

Figure 7:
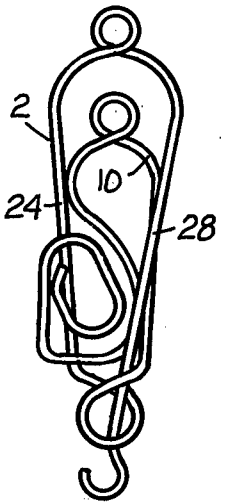
FIG. 7 is a front view in elevation of a fabric clasp in a fifth locking position.

Fabric clasp 2 of FIG. 7 illustrates a fifth positioning desirable for its application as a rope cinch wherein inner component 10 is twisted and held contiguously firm by friction created between component locking leg 28 and leg 24.

Figure 8:
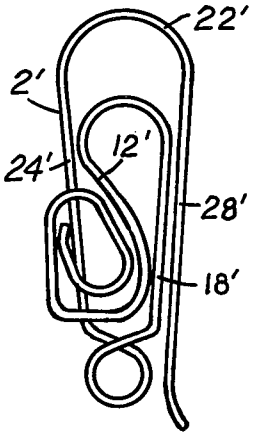
FIG. 8 is a front view in elevation of a modified form of fabric clasp embodying this invention.

In FIG. 8 there is shown a slightly modified form of fabric clasp 2 wherein eyelet-like loops, as shown by component parts 16 and 26 of FIG. 3, are omited from embodiment 2' of FIG. 8 thereby connecting outer legs 24' and 28' with a single, semicircular curvature 22' and inner component S-like leg 12' connecting directly to leg 18'.

Figure 9:
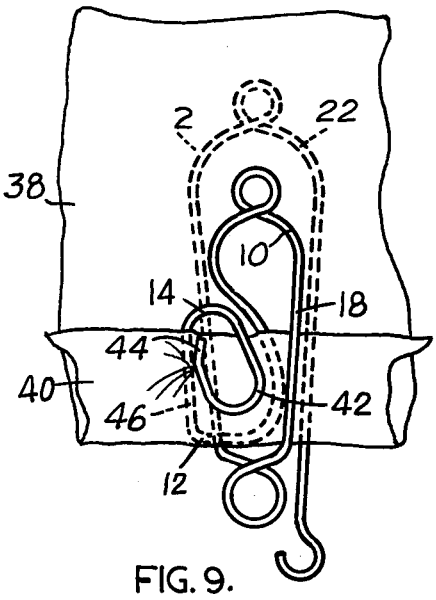
FIG. 9 is a view in perspective of a fabric clasp in a first position, as illustrated by FIG. 3, enclasping fabric.

In FIG. 9, folded fabric 38 is shown engaged by fabric clasp 2 in position one, as illustrated in FIG. 3, with the outer component 22 disposed on the underside of fabric 35 and inner component 10 disposed on the top side of fabric 38. The hem-like part 40 of fabric 38 has been inserted between component parts 12, 14, 18, and clasped rearward of curvature 42 thus allowing the hem-like part 40 to be pinched between clip 14, end portion 44, and its leg 46. S-like leg 12 provides a pivot and stop at the fold of hem-like part 40.

Figure 10:
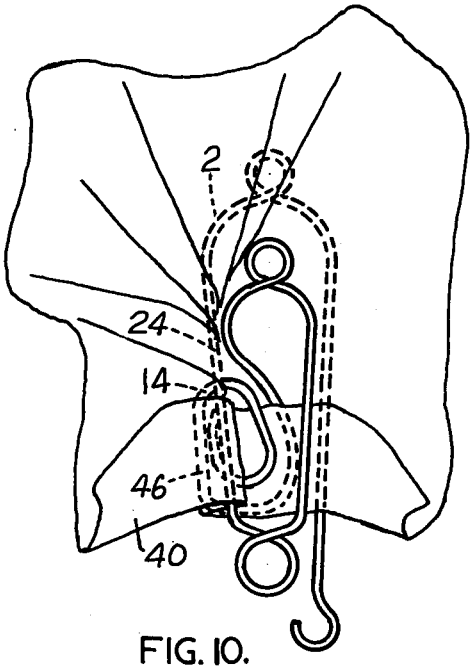
FIG. 10 is a view in perspective of a fabric clasp, having been passed through the second position to a third position as shown in FIGS. 4 and 5, locked within the fabric folds at one side of the elongated device.

In FIG. 10, fabric clasp 2, positioned as illustrated in FIG. 5, shows that hem-like part 40 is pivoted rearward of and clasped between outer component leg 24 and inner component clip 14 illustrating that legs 24 and 46 are used as fabric pivots.

Figure 11:
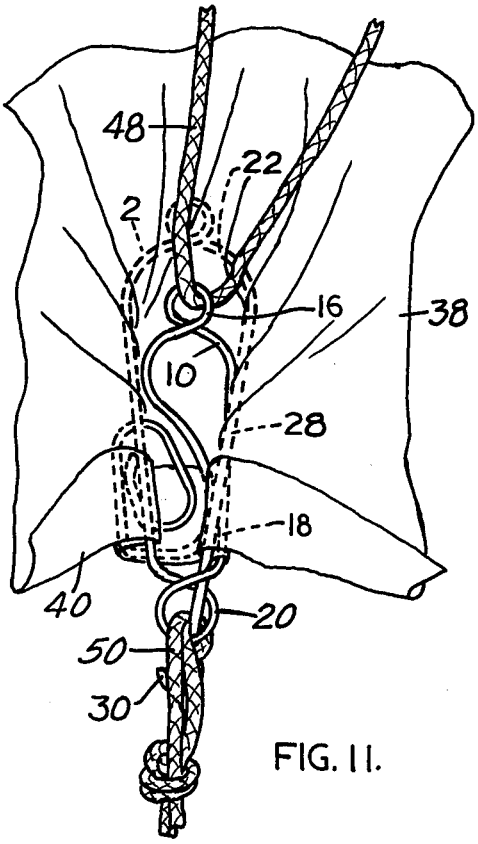
FIG. 11 is a view in perspective of a fabric clasp in the fourth position, as illustrated in FIG. 6, locked within the folds of fabric showing one method of rope attachment.

FIG. 11 shows a fabric clasp 2 manipulated to a fourth position, as illustrated in FIG. 6, and clasping fabric 38 now at both sides. Inner component 10 is positioned rearward of outer component 22 and secured by the locking action of hooked leg 28. Fabric 38 has been pivoted around legs 18 and 28 and clasped therebetween. One method of rope attachment is shown whereby rope 48 is attached to eyelet-like loop 16 therethrough, illustrating also the rearwardly set position of inner component 10. Looped rope 50, attached to hook 30, passes through grommet-like loop 20 at a place which prevents hooked leg 28 from becoming laterally dislodged. If the fabric clasp arrangement of FIG. 11 were to be reversed and placed against a polished or painted surface such as furniture or a truck bed side wall, the rearwardly set position of component 10, even without attached rope 48, would prevent the maring or scratching of said surface by wire clasp 2 due to the cushion-like effect of fabric 38, hem-like part 40, and rope 50 pressing or riding against said marable surface.

Figure 12:
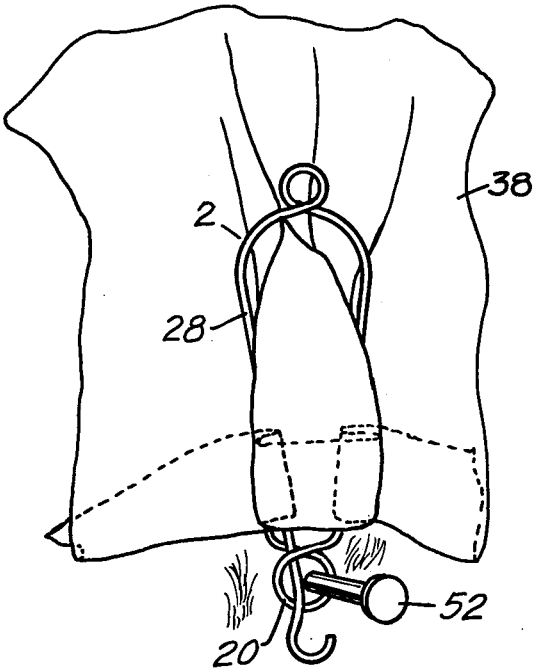
FIG. 12 is a view in perspective of a fabric clasp attached to fabric, as shown in FIG. 11, but reversed to illustrate one method of anchoring the clasp to the ground with a nail-like tent stake.

In FIG. 12, fabric clasp 2 clasps fabric 38, as described and shown by FIG. 11, but is reversed to expose to view hooked leg 28 and shows grommet-like loop 20 anchored to the earth by nail-like tent stake 52 wherein said stake is positioned through loop 20 so as to prevent hooked leg 28 from becoming laterally dislodged.

Figure 13:
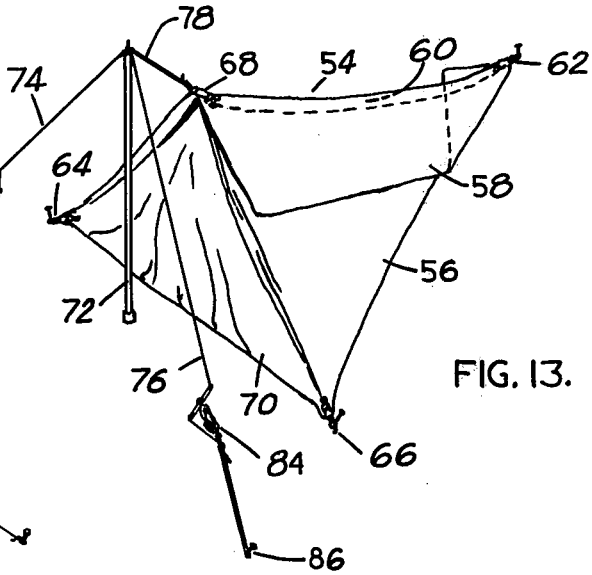
FIG. 13 is a view in perspective showing the application of fabric clasps for holding together an assembly of material which form a water resisting shelter or tent structure.

FIG. 13 illustrates one application of FIG. 12 fabric clasp arrangement and positioning wherein a plurality of fabric clasp arrangement and positioning wherein a plurality of fabric clasps are required to set up a rain and wind repellent tent shelter 54. An inexpensive plastic or fabric tarpaulin 56 of rectangular shape is first squared and then folded from three corners to form overlapping ends 58 and 60 and then structured to fashion a pyramid-like tent shelter 54 by anchoring its triangular base to the ground at three corners with attached fabric clasp tentstake assemblies 62, 64, and 66 and held erect by a fabric clasp 68 attached to the tent's pyramid-like vertex. The tent's entry is opened and closed with triangular flap 70 which has attached thereto at its apex a fabric clasp hookable to the underside eyelet-like loop of fabric clasp 68 (not visable but later illustrated). Tent 54 is held erect by vertically placed tent pole 72 having attached to it ropes 74, 76, and 78 whereby rope 78 connects from the pole top to fabric clasp 68. Rope 74, connecting the pole top to fabric clasp 80, passes around tent stake 82. Rope 76, connecting the pole top to fabric clasp 84, passes around tent stake 86. It is shown that fabric clasps 80 and 84 are applied as fulcrums for tightening and loosening ropes 74 and 76 respectively.

Figure 14:
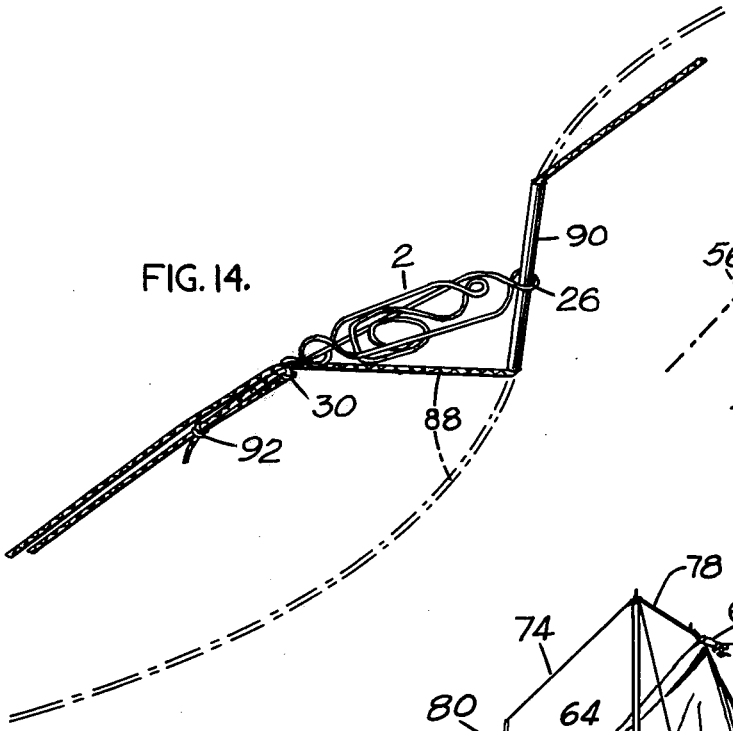
FIG. 14 is an enlarged detail view in perspective of a fabric clasp, as illustrated in FIG. 13, applied as a fulcrum for a rope cinch.

In FIG. 14, there is shown an enlarged detail of fabric clasp 2 arranged in the fifth position, as illustrated by FIGS. 7 and 13, and applied as a fulcrum for a rope cinch wherein rope 88 (shown by solid and phantom lines), after having been passed downward from an attachment through an inflexible tube 90 and around another attachment below, is returned upward to be engaged by its looped and knotted end 92 on fabric clasp hook 30. Eyelet-like loop 26 holds within its circumference tube 90 at midway of the tube's length. As fabric clasp 2 and tube 90 are then moved upward, rope 88 is pulled taut as illustrated in FIG. 13 by rope 74. To prevent downward slipping of fabric clasp 2 and wedged tube 90, a greater bend of rope 88 is created for locking friction at the ends of tube 90 by hooking a portion of rope 88 over hook 30 adjacent to knotted and looped rope end 92, as illustrated in FIG. 13 by rope 76.

Figure 15:
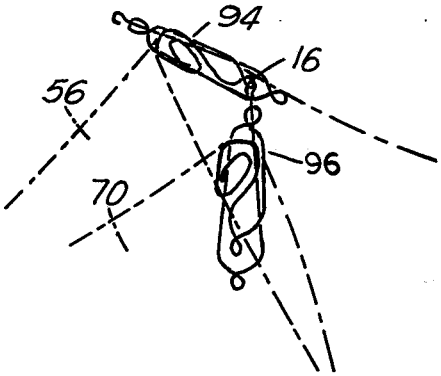
FIG. 15 is an enlarged detail view in perspective of fabric clasps applied as connectors to hold a tent flap closed, as illustrated in FIG. 13.

FIG. 15 shows an enlarged detail view of the fabric clasp arrangement illustrated by fabric clasp 68 of FIG. 13. In FIG. 15, there is shown a fabric clasp 94 attached to tent fabric 56 (shown in phantom lines) whereby fabric clasp 96, enclasping tent fabric 70 (shown by phantom lines), is hung by its hooked end to eyelet-like loop 16 of fabric clasp 94. It should be noted that enclasped entry flap 70 produces an underhung relationship to tent fabric 56 thus permitting tent fabric 56 to act as an eave for a tent structure and thereby preventing rain water from entering the tent's interior. It should also be noted that sufficient air space is created between fabrics 56 and 70 at their vertices to allow for proper tent ventilation.

Figure 16:
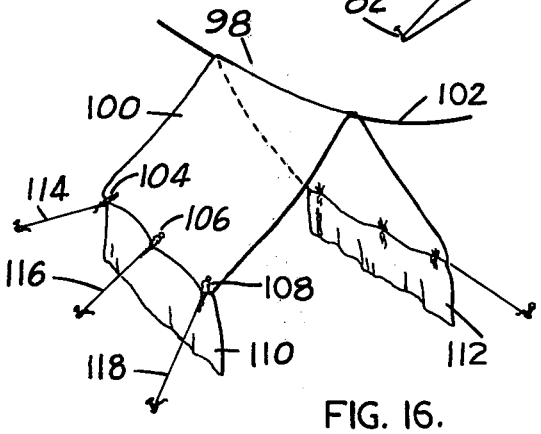
FIG. 16 is a perspective view of fabric clasps attached to the sides of a tarpaulin's length to shorten it for use as a canopy.

FIG. 16 shows a canopy shelter 98 made from tarpaulin fabric 100 suspended by a rope 102 midway of the fabric's length whereupon fabric clasps 104, 106 and 108 are attached to the top side of fabric 100 near one end with opposing clasps similarly attached (not visable or enumerated) at the other end to permit end flaps 110 and 112 to hang downward vertically and adjacent to the ground surface. Tent-like canopy 98 is held in place by rope and anchored stake assemblies 114, 116, and 118 attached to the grommet-like loop of fabric clasps 104, 106, and 108 respectively. It should be noted that similar and opposing assemblies are attached at the fabric's other end but are not fully viewed or enumerated.

Figure 17:
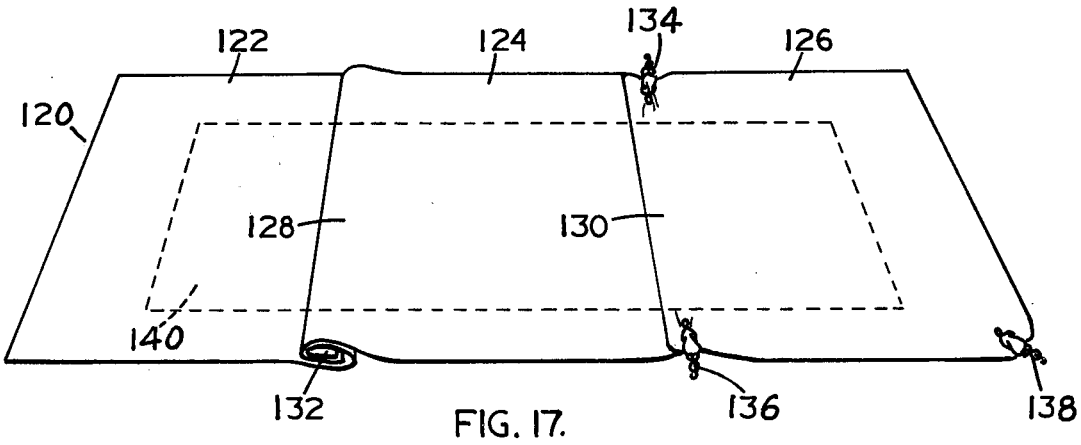
FIG. 17 is a perspective view of overlapped tarpaulins being locked together at their contiguous edges with fabric clasps.

In FIG. 17, there is shown a water resistant fabric assembly 120 whereby fabrics 122, 124, and 126 are circularly engaged at overlapping sides 128 and 130 illustrated by corner 132. To fabrics 124 and 126 there is seen fabric clasps 134 and 136 attached and locking together said fabrics at their contiguously folded edges thus illustrating a method by which a multiplicity of fabrics can be connected for water resisting applications. Fabric clasp 138 is shown to illustrate that fabric clasps may be easily attached to a fabric's corners. It should be noted that if, for example, fabric assembly 120 were placed over a pile of wood as a protective cover against sun light and rain, the downward bending of said fabric's perimeters over said wood pile's top surface, as suggested by hidden lines 140, would help stabilize the interlocking action of folds 128 and 130.

Figure 18:
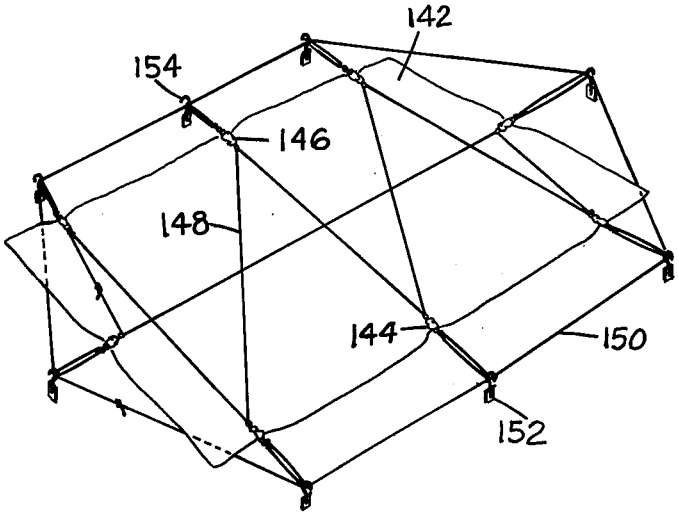
FIG. 18 is a perspective view of fabric clasps attached to the edges of a rectangular fabric illustrating the use of ropes, connected to both ends of the clasps, for controlling the stress placed upon the fabric when it is stretched between the clasps.

FIG. 18 shows a single, light weight plastic tarp 142 wherefrom there is attached upon its perimeter at spaced intervals and in an opposing relationship a plurality of fabric clasps such as fabric clasps 144 and 146. A rope 148 is shown attached to one eyelet-like end of each fabric clasp and interlaced between them across the top surface of tarp 142. When rope 150, attached to the hooked end of said fabric clasps and adjacent outer hooks as illustrated by hooks 152 and 154, is tightened, the stress within tarp 142 is relieved by the opposing force of inner rope 148 and outer rope 150. If tarp 142 were applied as a protective cover for articles loaded in a truck bed, for example, rope 148 could also help to secure said truck beb articles from shifting about while the truck is in transit. The application above described can be accomplished by the use of a standard grommeted tarp if it is of correct size. However, the advantages derived by folding down a large tarp at its four sides to a desired size and then attaching fabric clasps for grommet use, as hereinbefore shown by FIG. 16, should now become obviously apparent.

Figure 19:
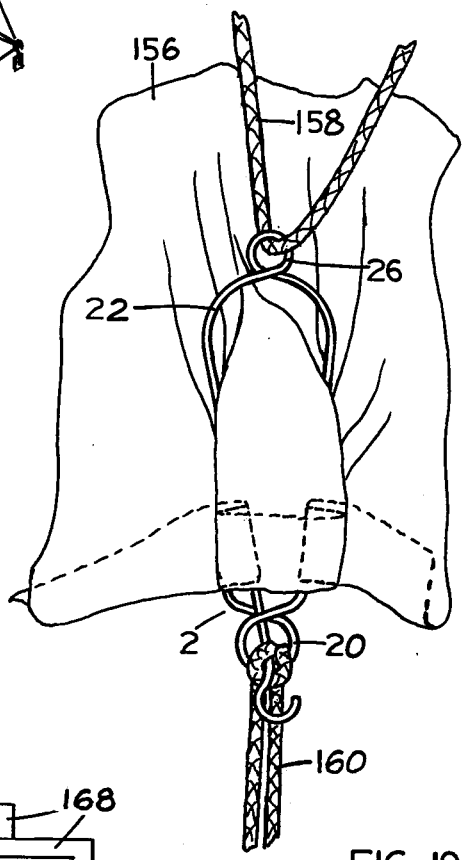
FIG. 19 is an enlarged detail view in perspective of one fabric clasp, as shown in FIG. 18, with ropes engaging both ends of the elongated clasp.

FIG. 19 is an enlarged view of the fabric clasp, rope, and fabric arrangement illustrated in FIG. 18 by fabric clasp arrangement 144. The detail of FIG. 19 shows fabric clasp 2 attached to fabric 156 with ropes 158 and 160 connected to eyelet-like and grommet-like loops 26 and 20 respectively. Rope 158 can be more easily attached for purposes of cinching if, as illustrated by rope 160 attachment, it were passed through curvature 22 and then looped over eyelet-like loop 26. It should be understood that if great tension is needed after connecting ropes 158 and 160, then rope 158 may be connected directly to rope 160 thus preventing damage to fabric clasp 2 configuration.

In FIG. 20 there is shown fabric clasp 2 mounted vertically within solid base 164 and used on a desk or table as an article holder where cup 166 could contain paper clips, pins, or like objects. Letter envelopes 168 are clasped between outer component configuration 22 and inner component parts 10 showing a memo 170 clasped within clip portion 14. Pencil 172 and pen 174 are held by friction within eyelet-like loops 26 and 16 respectively.

Although the device of my invention has been hereinbefore described as a bent and resilient wire, it is foreseeable that other material such as plastic could be used in a forming process to create a like, resilient embodiment, and further, its size and configuration having been generally established, it should, however, be understood that modifications regarding its size, shape, construction, or arrangement of integral parts could be made without departing from the spirit and scope of the invention as herein disclosed by the following appended claims.

I claim:

1. A clasping device of resilient filamentoid material comprising:

(a) a first clip having a first elongated coplanar convolution with first and second spaced side legs and a third adjacent, rearwardly directed side leg for clipping a hem-like portion of folded fabric;

(b) a second longer clip integrally connected to said first clip and reversely positioned to be substantially parallel to, laterally rearward of, and adjacent said first clip, said second clip for clasping said folded fabric and formed by (1) a second elongated convolution having a fourth side leg of S-like shape connecting at one end to (2) one end of a fifth side leg, said fifth side leg's other end integrally connected by an outwardly extending, circular loop to (3) a third convolution having a sixth side leg, a curvature, and a seventh terminating side leg, said third convolution surrounding said second convolution;

(c) means for pivoting said first clip, containing said hem-like portion therewithin, rearward of said third convolution;

(d) means for pivoting said enclasped and folded fabric around said fifth side leg and hooking said seventh side leg within said loop.

2. An assembly comprising the clasping device of claim 1 and means for preventing undesired lateral movement of said seventh side leg when hooked within said loop.

3. A clasping device of claim 1, further comprising an outwardly extending, circular loop integrally formed within said fourth side leg.

4. A clasping device of claim 1, further comprising an outwardly extending, circular loop integrally formed within said third convolution curvature.

5. A clasping device of claim 1, further comprising an outwardly extending, circular loop formed within said fourth side leg, and an outwardly extending, circular loop formed within said third convolution curvature.

6. A clasping device of claim 1, further comprising an outwardly extending hoop integrally connected to the end portion of said seventh side leg.

7. A clasping device of claim 5, further comprising an outwardly extending, circular loop integrally formed within said fourth side leg.

8. A clasping device of claim 5, further comprising an outwardly extending, circular loop integrally formed within said third convolution curature.

9. A clasping device of claim 5, further comprising an outwardly extending, circular loop formed within said fourth side leg, and an outwardly extending, circular loop formed within said third convolution curvature.

10. A fabric clasp formed from a single resilient wire bent to successively shape its configuration comprising:

(a) a first elongated convolution forming an elongated first side leg with a bight to form an inwardly directed end portion, the other longer portion connected by a first outwardly extending, coplanar, semicircular curvature to one end of a second elongated side leg which extends parallel to said longer portion of the first side leg, the second side leg terminating at its other end in a second outwardly extending, coplanar, semicircular curvature which extends beyond said first side leg end portion and continues therefrom in a third elongated side leg which passes adjacent the outer side of said bight portion of the first side leg diverging laterally outward and rearward of said first side leg's longer portion connecting, by an inwardly directed bight, to (b) a second elongated convolution which exists in a plane adjacently rearward of and substantially parallel to said first convolution, said second convolution forming a fourth elongated side leg of S-like shape, the first portion of which surrounds said first curvature and second side leg continuing in a second portion to form a third reversed, semicircular curvature which includes, at its apex, a first outwardly extending, circular loop crossing contiguously rearward of said apex, said S-like side leg then continuing said third curvature so as to terminate in a fifth elongated side leg, said fifth side leg extending lengthwise of, adjacent to, and beyond said first portion of the S-like side leg, said fifth side leg shaped with a bight to form an outwardly extending, laterally inwardly directed end portion, a second connected outwardly extending, circular loop crossing rearward and adjacent said fifth side leg end portion with an inwardly extending, laterally outwardly directed end portion terminating with a bight, said bight connected to (c) a third elongated convolution existing in a plane substantially parallel to and rearwardly adjacent of said first convolution and second convolution, said third convolution forming a sixth elongated side leg extending lengthwise of and diverging laterally outward from said axis passing rearward of and adjacent said first elongated convolution and said S-like side leg terminating in a fourth outwardly extending, semicircular curvature surrounding said third curvature, said fourth curvature including bisectionally a third outwardly extending, circular loop located within said axis, crossing contiguously rearward and continuing therefrom said fourth curvature to terminate in a seventh elongated side leg, said seventh side leg converging laterally inward, extending lengthwise of, adjacent and substantially parallel with said fifth side leg passing beyond said second loop in a bight so as to form a laterally outwardly extending end portion connecting an inwardly directed, semicircular hooked end portion.

* * * * *